US012484664B2

(12) United States Patent
Patel

(10) Patent No.: US 12,484,664 B2
(45) Date of Patent: Dec. 2, 2025

(54) ADJUSTABLE HEEL SYSTEM

(71) Applicant: Rensselaer Polytechnic Institute, Troy, NY (US)

(72) Inventor: Priyank G. Patel, Phoenixville, PA (US)

(73) Assignee: Rensselaer Polytechnic Institute, Troy, NY (US)

( * ) Notice: Subject to any disclaimer, the term of this patent is extended or adjusted under 35 U.S.C. 154(b) by 11 days.

(21) Appl. No.: 18/394,051

(22) Filed: Dec. 22, 2023

(65) Prior Publication Data

US 2024/0206595 A1 Jun. 27, 2024

Related U.S. Application Data

(60) Provisional application No. 63/434,692, filed on Dec. 22, 2022.

(51) Int. Cl.
*A43B 3/24* (2006.01)
*A43B 21/42* (2006.01)

(52) U.S. Cl.
CPC ..... *A43B 21/42* (2013.01); *A43B 3/248* (2013.01)

(58) Field of Classification Search
CPC ..... A43B 3/246; A43B 3/248; A43B 3/35; A43B 21/30; A43B 21/42; A43B 21/48
See application file for complete search history.

(56) References Cited

U.S. PATENT DOCUMENTS

| | | | | |
|---|---|---|---|---|
| 2,707,341 A | | 5/1955 | Romano | |
| 2,888,755 A | | 6/1959 | Bartolucci | |
| 2,934,840 A | | 5/1960 | Mistarz | |
| 3,266,177 A | * | 8/1966 | Holden | A43B 21/50 36/36 C |
| 3,464,126 A | | 9/1969 | Sarkissian | |
| 3,805,418 A | | 4/1974 | Matuka et al. | |
| 4,416,072 A | | 11/1983 | Sarkissian | |
| 5,722,185 A | * | 3/1998 | Vigneron | A43B 3/35 36/2.6 |

(Continued)

FOREIGN PATENT DOCUMENTS

| | | | |
|---|---|---|---|
| CN | 202635763 U | 1/2013 | |
| CN | 105054491 B | 5/2017 | |

(Continued)

*Primary Examiner* — Sharon M Prange
(74) *Attorney, Agent, or Firm* — Barclay Damon LLP; Anthony P. Gangemi

(57) ABSTRACT

A footwear system includes an upper portion, a sole portion, and an adjustable heel. The adjustable heel includes a top section configured to the sole portion at a top surface of the top section. The top section defines a top section vertical cavity, a top section upper horizontal cavity, and a top section lower horizontal cavity. A movable top locking pin is positioned at least partially within the top section upper horizontal cavity. A bottom section is coupled to the top section and configured to extend beyond the bottom surface of the top section when extended and to be contained at least partially within the top section vertical cavity when retracted. A movable spring-loaded locking pin is positioned at least partially within a bottom section upper horizontal cavity. The spring-loaded locking pin is configured to hold the bottom section in an extended or retracted position.

14 Claims, 4 Drawing Sheets

(56) References Cited

U.S. PATENT DOCUMENTS

| | | | | |
|---|---|---|---|---|
| 5,887,360 | A | 3/1999 | Bucalo et al. | |
| 6,021,586 | A | 2/2000 | Bucalo et al. | |
| 6,578,289 | B1 * | 6/2003 | Bucalo | A43B 21/51 36/100 |
| 6,785,987 | B2 * | 9/2004 | Bucalo | A43B 21/51 36/100 |
| 7,059,068 | B2 | 6/2006 | Magallanes et al. | |
| 7,140,125 | B2 | 11/2006 | Singleton et al. | |
| 7,877,902 | B2 | 2/2011 | Pieriboni | |
| 8,112,908 | B2 | 2/2012 | Visser | |
| 8,281,503 | B2 | 10/2012 | Savill, Jr. | |
| 8,322,053 | B2 | 12/2012 | Handel et al. | |
| 8,453,351 | B1 | 6/2013 | Hale | |
| 8,631,592 | B2 | 1/2014 | Adair et al. | |
| 9,289,025 | B2 | 3/2016 | Damodar | |
| 9,326,565 | B1 | 5/2016 | Davis | |
| 10,426,218 | B2 * | 10/2019 | Harvey | A43B 21/42 |
| 11,564,447 | B1 * | 1/2023 | Lamothe | A43B 21/437 |
| 2006/0101670 | A1 | 5/2006 | Bucalo | |
| 2008/0134542 | A1 | 6/2008 | Shih | |
| 2012/0055048 | A1 * | 3/2012 | Haupt | A43B 21/30 36/34 R |
| 2015/0075032 | A1 * | 3/2015 | Skrepenski | A43B 21/437 36/100 |
| 2015/0201704 | A1 * | 7/2015 | Huber | A43B 21/36 36/25 R |
| 2016/0309833 | A1 * | 10/2016 | Beaufort | A43B 3/24 |
| 2018/0140048 | A1 * | 5/2018 | Shi | A43B 21/36 |
| 2020/0337415 | A1 * | 10/2020 | Chen | A43B 21/437 |
| 2023/0225457 | A1 * | 7/2023 | Crisafulli | A43B 21/48 36/34 R |

FOREIGN PATENT DOCUMENTS

| | | | | |
|---|---|---|---|---|
| EP | 1118282 | A2 * | 7/2001 | A43B 17/023 |
| GB | 2483900 | A * | 3/2012 | A43B 21/24 |
| GB | 2511150 | A * | 8/2014 | A43B 21/24 |
| WO | 2018077117 | A1 | 5/2018 | |

* cited by examiner

SECTION B-B

ADJUSTABLE HEEL SYSTEM

CROSS REFERENCE TO RELATED APPLICATIONS

This application claims the priority benefit of U.S. Provisional Patent Application No. 63/434,692, filed Dec. 22, 2022, the contents of which is incorporated by reference as if disclosed herein in its entirety.

FIELD

The present technology relates generally to footwear, and more particularly, to adjustable heel systems for footwear.

BACKGROUND

Footwear that has high heels may generally be considered relatively fashionable. Although high heel footwear may be aesthetically appealing, walking in high heel footwear for an extended period of time may result in back pain and/or muscle strain for the wearer. Walking in footwear having relatively low or flat heels, on the other hand, may not produce such back pain and/or muscle strains. However, the low or flat heel footwear may be less aesthetically appealing.

What is needed, therefore, are improved footwear and heel systems that address at least the problems described above.

SUMMARY

According to an embodiment of the present technology, an adjustable heel is provided. The adjustable heel includes a top section configured to couple to a sole portion of an article of footwear at a top surface of the top section. The top section defines a top section vertical cavity, a top section upper horizontal cavity, and a top section lower horizontal cavity. The top section vertical cavity has an opening in a bottom surface of the top section and each top section horizontal cavity extends between the top section vertical cavity and an external surface of the top section. A movable top locking pin is positioned at least partially within the top section upper horizontal cavity. A bottom section is coupled to the top section and configured to contact a walking surface at a bottom surface of the bottom section. The bottom section configured to extend beyond the bottom surface of the top section when extended and to be contained at least partially within the top section vertical cavity when retracted. The bottom section defines a bottom section upper horizontal cavity having an opening in an external surface of the bottom section. A movable spring-loaded locking pin is positioned at least partially within the bottom section upper horizontal cavity. The spring-loaded locking pin configured to hold the bottom section in an extended or retracted position when the spring-loaded locking pin is positioned partially within the bottom section upper horizontal cavity and the spring is at most partially compressed and to allow the bottom section to move when the spring-loaded locking pin is positioned completely within the bottom section upper horizontal cavity.

In some embodiments, at least one intermediate section is positioned between the top section and the bottom section. Each intermediate section defining a respective intermediate section vertical cavity, a respective intermediate section upper horizontal cavity, and a respective intermediate section lower horizontal cavity. Each intermediate section upper and lower horizontal cavities extending between the respective intermediate section vertical cavity and an external surface of the respective intermediate section. Each intermediate section configured to be contained in a next higher section vertical cavity with the respective intermediate section upper horizontal cavity aligned with a next higher section upper horizontal cavity when the intermediate section is in a retracted position and with the respective intermediate section upper horizontal cavity aligned with a next higher section lower horizontal cavity when the intermediate section is in an extended position. Each intermediate section vertical cavity configured to contain a next lower section with a next lower section upper horizontal cavity aligned with the respective intermediate section upper horizontal cavity when the next lower section is in a retracted position and with a next lower section upper horizontal cavity aligned with the respective intermediate section lower horizontal cavity when the next lower section is in an extended position. Each intermediate section upper horizontal cavity configured to contain at least partially a respective movable intermediate locking pin, each intermediate locking pin configured to hold the respective intermediate section in the extended or retracted position. Each intermediate locking pin configured to move to a locked position in response to a spring force of the spring-loaded locking pin or move to an unlocked position in response to an externally applied force.

In some embodiments, a vertical spring is configured to assist extending the bottom section. The vertical spring is positioned within each vertical cavity.

In some embodiments, each locking pin is configured to extend external to the external surface of its respective section when aligned with the spring-loaded locking pin.

According to another embodiment of the present technology, a footwear system is provided. The footwear system includes an upper portion, a sole portion, and an adjustable heel. The adjustable heel includes a top section configured to the sole portion at a top surface of the top section. The top section defines a top section vertical cavity, a top section upper horizontal cavity, and a top section lower horizontal cavity. The top section vertical cavity has an opening in a bottom surface of the top section and each top section horizontal cavity extends between the top section vertical cavity and an external surface of the top section. A movable top locking pin is positioned at least partially within the top section upper horizontal cavity. A bottom section is coupled to the top section and configured to contact a walking surface at a bottom surface of the bottom section. The bottom section configured to extend beyond the bottom surface of the top section when extended and to be contained at least partially within the top section vertical cavity when retracted. The bottom section defines a bottom section upper horizontal cavity having an opening in an external surface of the bottom section. A movable spring-loaded locking pin is positioned at least partially within the bottom section upper horizontal cavity. The spring-loaded locking pin configured to hold the bottom section in an extended or retracted position when the spring-loaded locking pin is positioned partially within the bottom section upper horizontal cavity and the spring is at most partially compressed and to allow the bottom section to move when the spring-loaded locking pin is positioned completely within the bottom section upper horizontal cavity.

In some embodiments, the adjustable heel includes at least one intermediate section is positioned between the top section and the bottom section. Each intermediate section defining a respective intermediate section vertical cavity, a respective intermediate section upper horizontal cavity, and a respective intermediate section lower horizontal cavity. Each intermediate section upper and lower horizontal cavities extending between the respective intermediate section vertical cavity and an external surface of the respective intermediate section. Each intermediate section configured to be contained in a next higher section vertical cavity with the respective intermediate section upper horizontal cavity aligned with a next higher section upper horizontal cavity when the intermediate section is in a retracted position and with the respective intermediate section upper horizontal cavity aligned with a next higher section lower horizontal cavity when the intermediate section is in an extended position. Each intermediate section vertical cavity configured to contain a next lower section with a next lower section upper horizontal cavity aligned with the respective intermediate section upper horizontal cavity when the next lower section is in a retracted position and with a next lower section upper horizontal cavity aligned with the respective intermediate section lower horizontal cavity when the next lower section is in an extended position. Each intermediate section upper horizontal cavity configured to contain at least partially a respective movable intermediate locking pin, each intermediate locking pin configured to hold the respective intermediate section in the extended or retracted position. Each intermediate locking pin configured to move to a locked position in response to a spring force of the spring-loaded locking pin or move to an unlocked position in response to an externally applied force.

In some embodiments, the adjustable heel includes a vertical spring configured to assist extending the bottom section. The vertical spring is positioned within each vertical cavity.

In some embodiments, each locking pin is configured to extend external to the external surface of its respective section when aligned with the spring loaded-locking pin.

In some embodiments, a heating element is positioned adjacent a toe section of the sole portion.

In some embodiments, the sole portion includes at least one flexible section configured to accommodate varying heights of the adjustable heel. In some embodiments, the sole portion includes a first flexible section positioned adjacent a toe section and a second flexible section adjacent an arch section.

According to yet another embodiment of the present technology, a footwear system is provided. The footwear system includes an upper portion, a sole portion, and an adjustable heel. The adjustable heel includes a top section configured to the sole portion at a top surface of the top section. The top section defines a top section vertical cavity, a top section upper horizontal cavity, and a top section lower horizontal cavity. The top section vertical cavity has an opening in a bottom surface of the top section and each top section horizontal cavity extends between the top section vertical cavity and an external surface of the top section. A movable top locking pin is positioned at least partially within the top section upper horizontal cavity. A bottom section is coupled to the top section and configured to contact a walking surface at a bottom surface of the bottom section. The bottom section configured to extend beyond the bottom surface of the top section when extended and to be contained at least partially within the top section vertical cavity when retracted. The bottom section defines a bottom section upper horizontal cavity having an opening in an external surface of the bottom section. A movable spring-loaded locking pin is positioned at least partially within the bottom section upper horizontal cavity. The spring-loaded locking pin configured to hold the bottom section in an extended or retracted position when the spring-loaded locking pin is positioned partially within the bottom section upper horizontal cavity and the spring is at most partially compressed and to allow the bottom section to move when the spring-loaded locking pin is positioned completely within the bottom section upper horizontal cavity. At least one intermediate section is positioned between the top section and the bottom section. Each intermediate section defining a respective intermediate section vertical cavity, a respective intermediate section upper horizontal cavity, and a respective intermediate section lower horizontal cavity. Each intermediate section upper and lower horizontal cavities extending between the respective intermediate section vertical cavity and an external surface of the respective intermediate section. Each intermediate section configured to be contained in a next higher section vertical cavity with the respective intermediate section upper horizontal cavity aligned with a next higher section upper horizontal cavity when the intermediate section is in a retracted position and with the respective intermediate section upper horizontal cavity aligned with a next higher section lower horizontal cavity when the intermediate section is in an extended position. Each intermediate section vertical cavity configured to contain a next lower section with a next lower section upper horizontal cavity aligned with the respective intermediate section upper horizontal cavity when the next lower section is in a retracted position and with a next lower section upper horizontal cavity aligned with the respective intermediate section lower horizontal cavity when the next lower section is in an extended position. Each intermediate section upper horizontal cavity configured to contain at least partially a respective movable intermediate locking pin, each intermediate locking pin configured to hold the respective intermediate section in the extended or retracted position. Each intermediate locking pin is configured to move to a locked position in response to a spring force of the spring-loaded locking pin or move to an unlocked position in response to an externally applied force. A vertical spring is configured to assist extending the bottom section. The vertical spring is positioned within each vertical cavity and having a first end connected to a bottom surface of the sole portion and a second end connected to a top surface of the bottom section. Each locking pin is configured to extend external to the external surface of its respective section when aligned with the spring-loaded locking pin.

In some embodiments, a heating element is positioned adjacent a toe section of the sole portion.

In some embodiments, the sole portion includes a plurality of flexible sections configured to accommodate varying heights of the adjustable heel.

Further objects, aspects, features, and embodiments of the present technology will be apparent from the drawing Figures and below description.

BRIEF DESCRIPTION OF DRAWINGS

Some embodiments of the present technology are illustrated as an example and are not limited by the figures of the accompanying drawings, in which like references may indicate similar elements.

DETAILED DESCRIPTION

Embodiments of the present technology are directed to an adjustable heel system for footwear. Footwear, i.e., an article of footwear, may include, but is not limited to, boots, shoes, sandals, etc. The adjustable heel system includes a plurality of telescoping sections configured to extend for maximum heel height and to retract for a reduced heel height. The fully extended position may be relatively less comfortable but relatively more aesthetically appealing. The fully retracted position is configured to be relatively more comfortable for the wearer and may facilitate walking for an extended period of time without ill-effects. Thus, footwear that includes an adjustable heal system, consistent with the present technology, may provide aesthetic appeal when extended as well as comfort for walking when retracted. In some embodiments, the adjustable heel height may be adjusted by pressing a pin.

In some embodiments, an adjustable heel includes a retracting feature configured to allow a height to be adjustable, including retracting into a relatively flat heel. In some embodiments, the adjustable heel is retracted using the weight of the wearer. In some embodiments, the retracting is initiated by, for example, a push of a pin or push of a button. In some embodiments, the adjustable heel is configured to extend, i.e., expand, under a spring force of a spring compressed between a sole of the footwear and the heel. In some embodiments, at least a portion of the adjustable heel system is manufactured using recycled materials and/or renewable materials such as wood. However, the present technology is not limited in this regard and contemplates embodiments in which the adjustable heel system is formed of different materials, such as a 3D printed material, cotton, leather, synthetic leather, etc.

In some embodiments, the adjustable heel has a range of possible heights. In some embodiments, a minimum height that corresponds to fully retracted corresponds to a height of the top section. In one example, the minimum height is 1 inch. In another example, the minimum height is 1.5 inches. In some embodiments, a maximum height that corresponds to fully extended is related to the respective height of each section of the adjustable heel. In one example, the maximum height is 4 inches. In another example, the maximum height is 6 inches. However, the present technology is not limited in this regard and contemplates embodiments in which the adjustable heel has different minimum and maximum heights.

Figure 1:
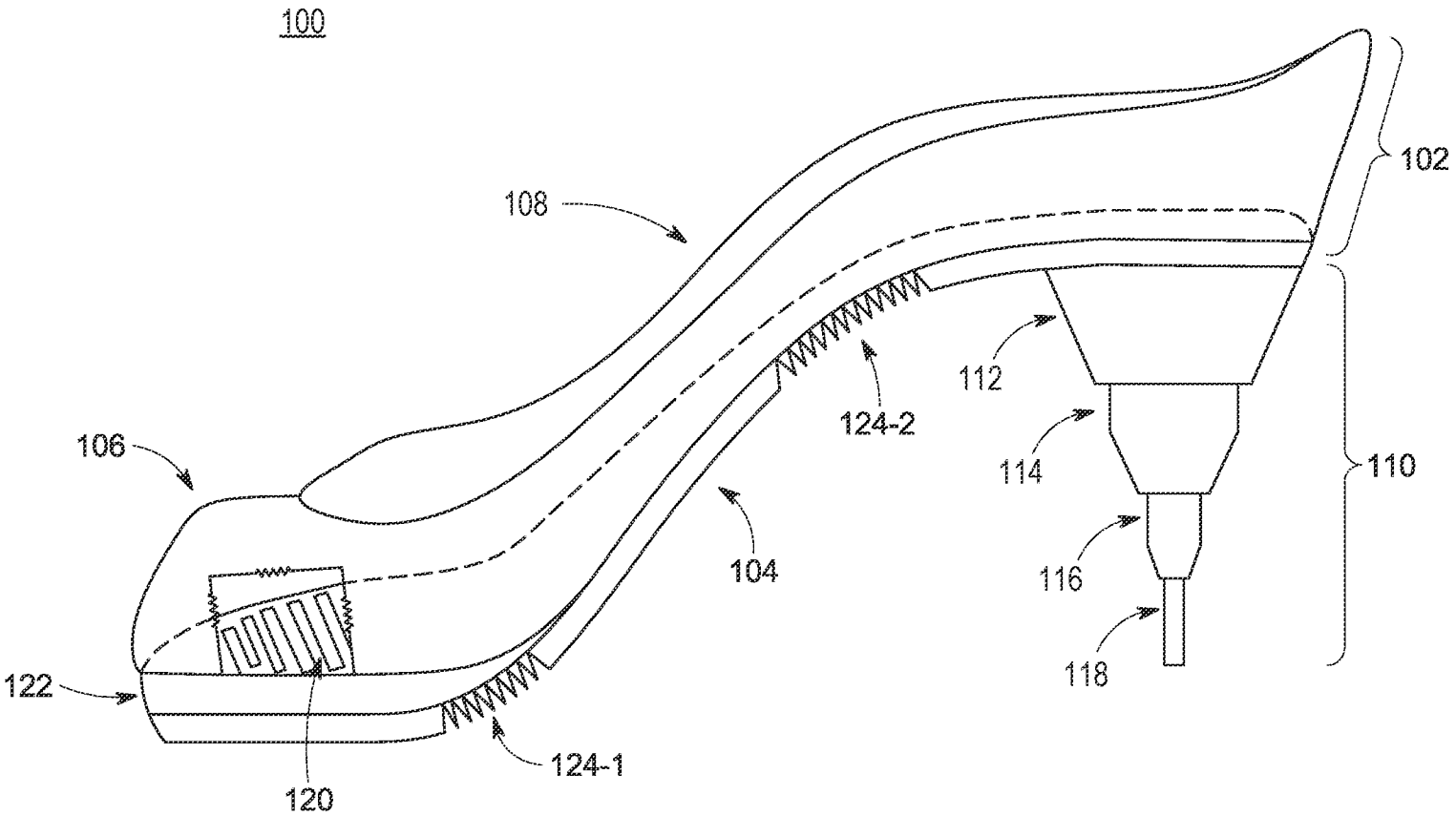
FIG. 1 is a side view of a footwear system having an adjustable heel according to some embodiments of the present technology.

As shown in FIG. 1, an article of footwear is generally designated by the numeral 100. An article of footwear ("footwear") may include, but is not limited to, a boot, a shoe, a sandal, etc. Footwear 100 includes an upper portion 102 and a sole portion 104. Footwear 100 further includes an adjustable heel 110. In some embodiments, adjustable heel 110 includes a plurality of telescoping sections 112, 114, 116, 118 that are configured to extend and retract to adjust the height of the adjustable heel 100, as discussed in more detail below. In some embodiments, footwear 100 includes a heating element 120 position at or adjacent a toe section 106. In some embodiments, a relatively thick portion 122 is positioned between the sole portion 104 and the upper portion 102 at or adjacent the toe section 106. In some embodiments, the relatively thick portion 122 is configured to house a battery that is configured to power the heating element 120. In some embodiments, the sole portion 104 includes one or more flexible sections, e.g., flexible sections 124-1, 124-2, configured to accommodate varying heights of adjustable heel 110. In other words, flexible features 124-1, 124-2 are configured to allow deformation of sole portion 104 so that the toe section 106 may generally remain flat on a walking surface for a range of adjustable heel heights. In some embodiments, flexible section 124-1 is positioned at or adjacent the toe section 106. In some embodiments, flexible section 124-2 is positioned at or adjacent an arch section 108. Thus, in some embodiments, an adjustable height heel 110 is included in an article of footwear 100 and is configured to provide both aesthetic appeal and walking comfort.

Figure 2A:
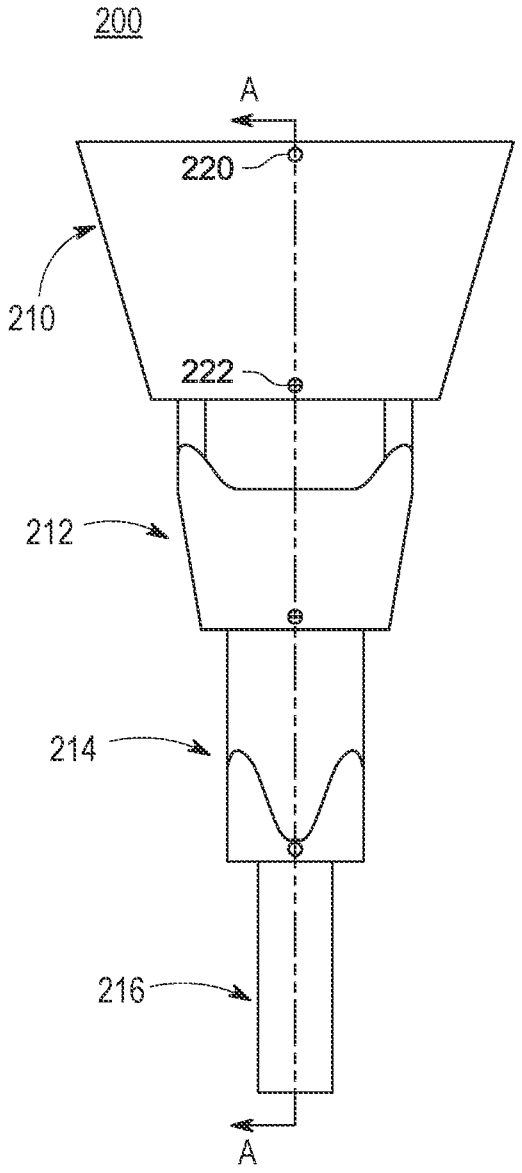
FIG. 2A is a side view of a fully extended adjustable heel according to some embodiments of the present technology.
Figure 2B:
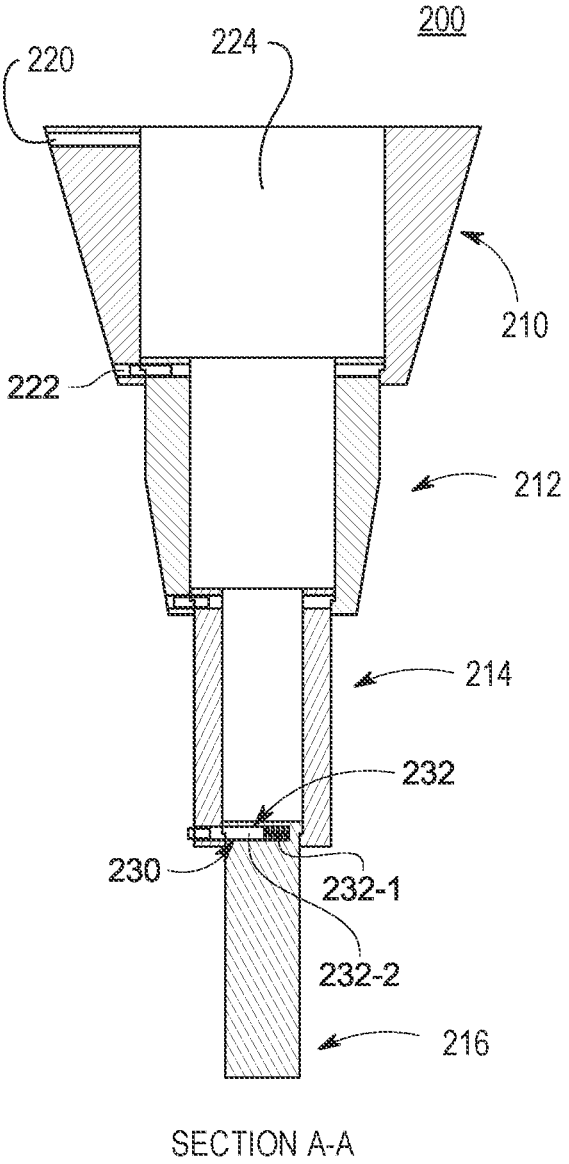
FIG. 2B is a cross-sectional view of the fully extended adjustable heel of FIG. 2A along section line A-A.

As shown in FIGS. 2A-2B, an adjustable heel is generally designated by the numeral 200. In some embodiments, the adjustable heel 200 includes four sections. However, the present technology is not limited in this regard and contemplates embodiments in which the adjustable heel 200 includes a different number of sections, such as two sections, three sections, five sections, six sections, etc. In the embodiment shown, the adjustable heel 200 includes a top section 210, two intermediate sections 212, 214, and a bottom section 216. Each section defines an upper horizontal cavity, e.g., upper horizontal cavity 220 of the top section 210. The top section 210 and two intermediate sections 212, 214 each further define a respective lower horizontal cavity, e.g., lower horizontal cavity 222 of the top section 210. The top section 210 and two intermediate sections 212, 214 further define a respective vertical cavity, e.g., top section vertical cavity 224. The bottom section 216 defines a bottom section upper cavity 230 that includes a spring-loaded locking pin 232. The spring-loaded locking pin 232 includes a spring portion 232-1 and a pin portion 232-2. Applying a force to the spring-loaded locking pin 232 permits a wearer of the footwear to extend or retract respective sections to adjust the height of the adjustable heel 200, as discussed in more detail below.

Figure 3A:
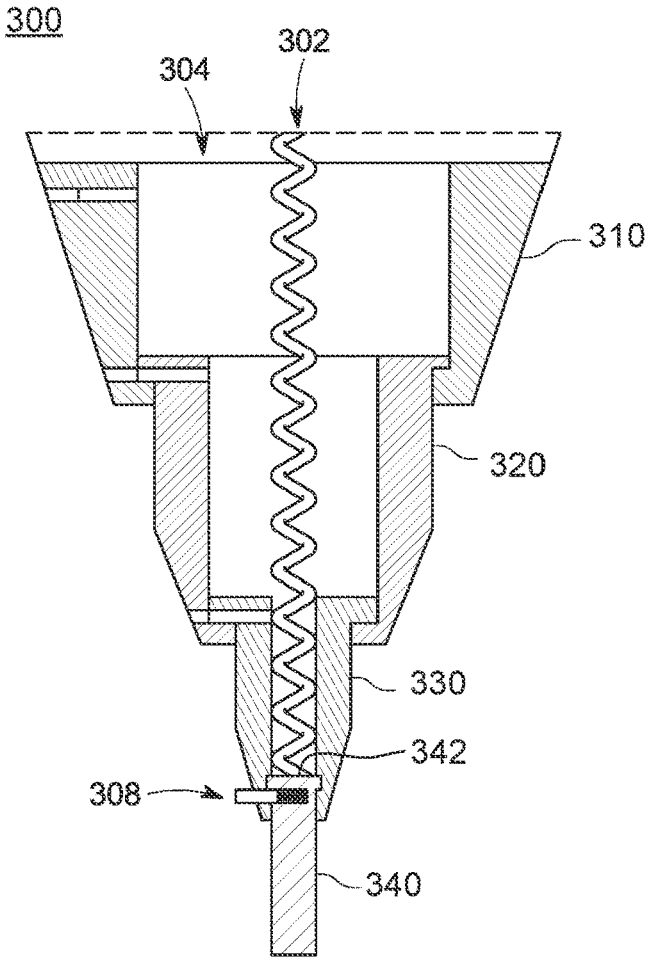
FIG. 3A is a cross-sectional view of a fully extended adjustable heel according to some embodiments of the present technology.
Figure 3B:
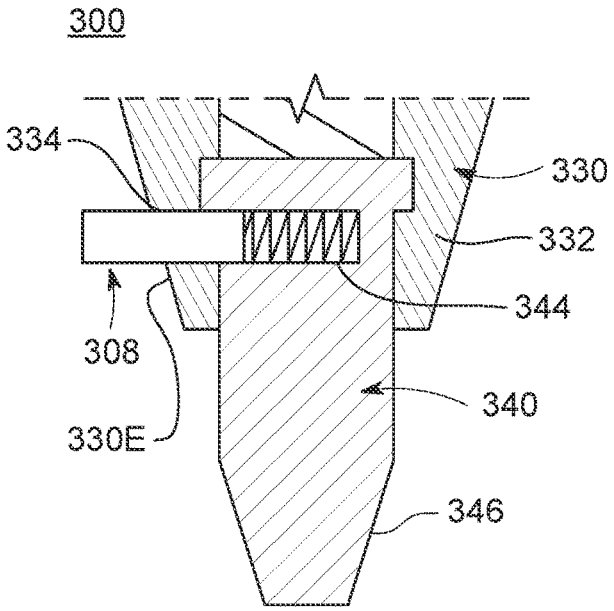
FIG. 3B is a cross-sectional view of a portion of an adjustable heel according to some embodiments of the present technology.

As shown in FIGS. 3A-3B, an adjustable heel is generally designated by the numeral 300. As shown in FIG. 3A, adjustable heel 300 includes four sections, 310, 320, 330, 340, similar to adjustable heel 200 discussed above. Adjustable heel 300 includes a vertical spring 302. Vertical spring 302 extends from a top surface 304 of the adjustable heel 300 to a top surface 342 of the bottom section 340. Thus, in some embodiments, the vertical spring 302 is coupled to a bottom surface of a sole portion of a footwear. The vertical spring 302 is configured to facilitate extending the adjustable heel 300. Adjustable heel 300 includes a spring-loaded locking pin 308, as described herein, positioned in an upper horizontal cavity defined by the bottom section 340. In this example, the bottom section 340 has a generally rectangular cross-section. However, the present technology is not limited in this regard and contemplates embodiments in which the bottom section 340 has a different shaped cross-section.

As shown in FIG. 3B, adjustable heel 300 includes the bottom section 340 and a lower portion 332 of an intermediate portion 330. FIG. 3B illustrates the spring-loaded locking pin 308 positioned in a horizontal cavity 344 of the bottom section 340 and a lower horizontal cavity 334 of the intermediate section 330. In some embodiments, spring-loaded locking pin 308 extends beyond an external surface 330E of the intermediate section 330. Thus, applying a force to the spring-loaded locking pin 308, e.g., pushing, pressing, etc., permits a wearer of the footwear to position the spring-loaded locking pin 308 entirely within the horizontal cavity 344 and retract the bottom portion 340 within at least one of the above portions 310, 320, 330 to adjust the height of the adjustable heel 300. Similarly, applying a force to the spring-loaded locking pin 308 permits a wearer of the footwear to position the spring-loaded locking pin 308 entirely within a respective horizontal cavity of any of the sections 310, 320, 330, 340 to extend the respective sections to adjust the height of the adjustable heel 300. In some embodiments, the bottom section 340 has a tapered lower portion 346. However, the present technology is not limited in this regard and contemplates embodiments in which the bottom section 340 has a different shaped cross-section.

Figure 4A:
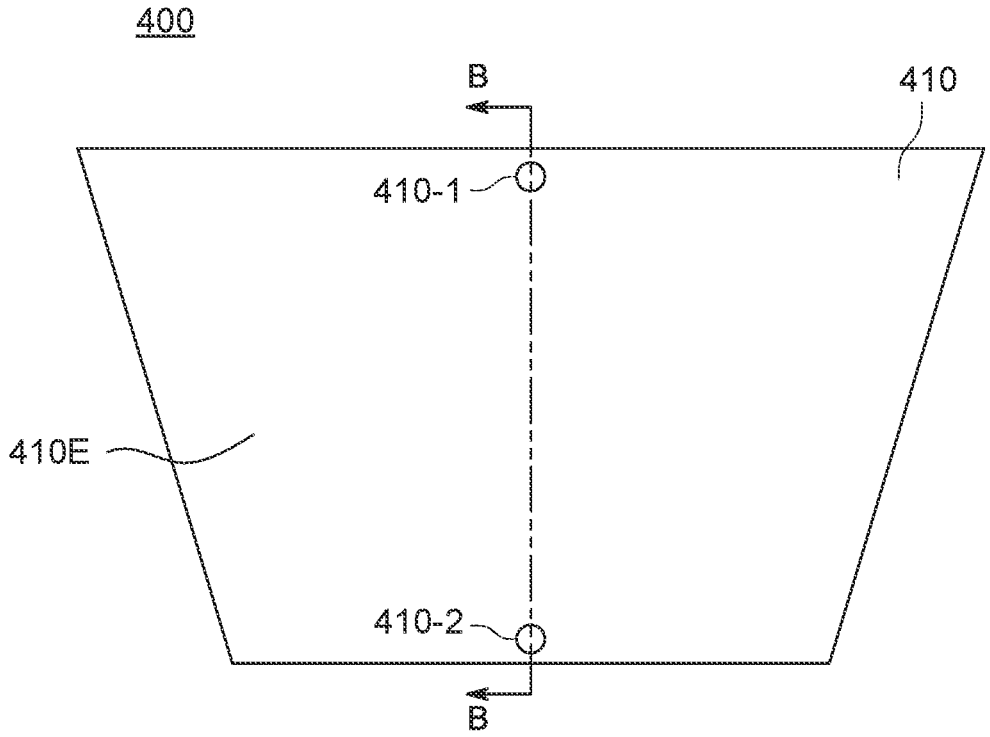
FIG. 4A is a side view of a fully retracted adjustable heel according to some embodiments of the present technology.
Figure 4B:
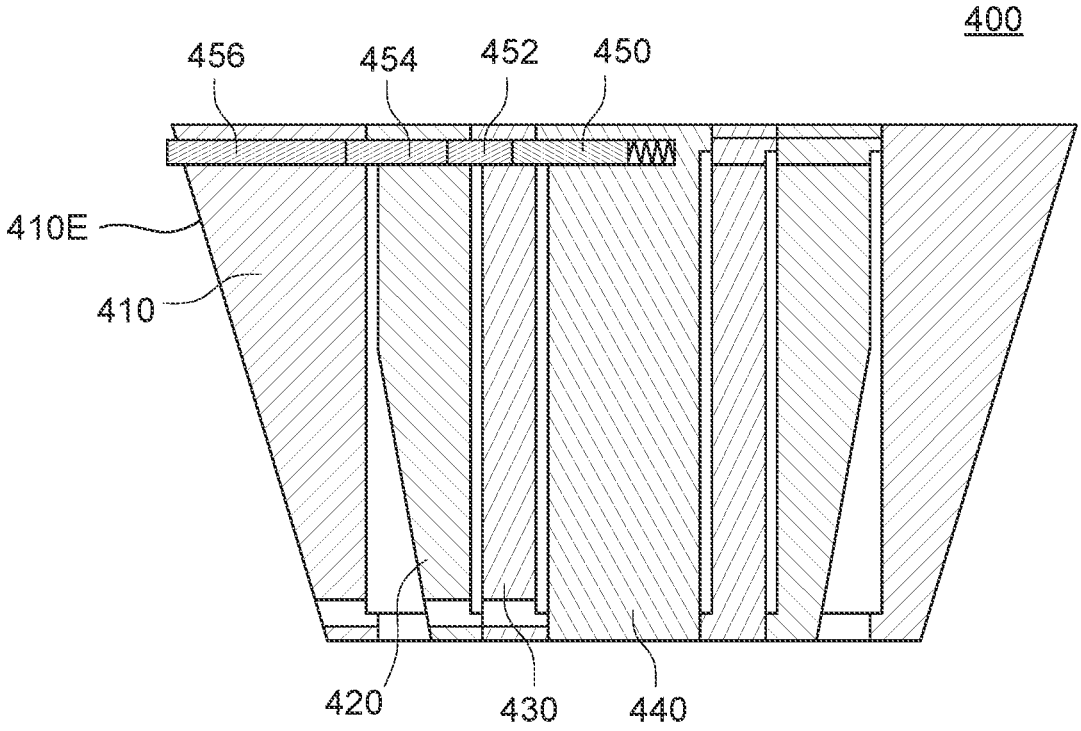
FIG. 4B is a cross-sectional view of the fully retracted adjustable heel of FIG. 4A along section line B-B.

As shown in FIGS. 4A-4B, an adjustable heel is generally designated by the numeral 400. Adjustable heel 400 is shown in a fully retracted position. FIG. 4A shows an external surface 410E of a top section 410 of adjustable heel 400. The external surface 410E defines two openings 410-1, 410-2. Opening 410-1 corresponds to an upper horizontal cavity, as described herein. Opening 410-2 corresponds to a lower horizontal cavity, as described herein.

As shown in FIG. 4B, adjustable heel 400 includes top section 410, two intermediate sections 420, 430, and bottom section 440. FIG. 4B illustrates the alignment of the respective locking pins of the four sections when adjustable heel 400 is in a fully retracted position. The locking pins include a spring-loaded locking pin 450, two intermediate locking pins 452, 454, and a top locking pin 456. In some embodiments, each locking pin is at least partially contained within a respective upper horizontal cavity of its respective section. In some embodiments, top locking pin 456 extends beyond the external surface 410E of the top section 410 such that a wearer of the footwear may apply a force to the top locking 456 to position the locking pins in their respective upper horizontal cavities to extend or retract the respective sections to adjust the height of the adjustable heel 400, as discussed above regarding the adjustable heels disclosed herein.

In some embodiments, footwear 100 that includes an adjustable heel 110, 200, 300, 400 is constructed from a variety of materials. In some embodiments, the adjustable heel is constructed of steel and/or aluminum. In one nonlimiting example, the steel corresponds to AISI 4140 steel, i.e., a low alloy steel that includes added chromium, molybdenum, and manganese. In another example, the aluminum corresponds to AA 7075 aluminum alloy, i.e., a relatively high strength aluminum. In some embodiments, the sole portion 104 is constructed from a renewable material, e.g., wood. In some embodiments, the sole portion 104 is biodegradable. In some embodiments, the heating element corresponds to a copper strip or a copper wire, i.e., a conductor. In some embodiments, the battery is lithium ion. However, the present technology is not limited in this regard. In some embodiments, each locking pin and the locking pin spring are constructed of a steel material. In one nonlimiting example, the steel corresponds to stainless steel and may thus be configured to resist corrosion.

In some embodiments, the adjustable heel 110 includes a pressurized system configured to extend and retract the sections to adjust the height of the adjustable heel 110. In some embodiments, the pressurized system is a hydraulic lift system, a pneumatic lift system, a gas-powered lift system, etc. In some embodiments, the pressurized system includes a piston configured to extend or retract the adjustable heel sections. In some embodiments, the adjustment includes discrete height positions. In some embodiments, the piston includes a pancake piston. In these embodiments, the adjustable heel further includes tubing configured to convey air to and remove air from the adjustable heel. In some embodiments, at least a portion of an external surface of the adjustable heel is substantially flat. The flat external surface is configured to facilitate implementing a pressurized lift system, which is positioned at or adjacent the flat external surface. The adjustable heel with such a flat external surface may, in some circumstances, be aesthetically relatively more appealing.

Accordingly, in some embodiments, an adjustable heel system for footwear includes a plurality of telescoping sections configured to extend for maximum heel height and to retract for a reduced heel height. The fully extended position is configured to be relatively less comfortable but relatively more aesthetically appealing. The fully retracted position is configured to be relatively more comfortable for the wearer and may facilitate walking for an extended period of time without ill-effects. Footwear that includes an adjustable heal system provides aesthetic appeal when extended as well as comfort for walking when retracted.

As will be apparent to those skilled in the art, various modifications, adaptations, and variations of the foregoing specific disclosure can be made without departing from the scope of the technology claimed herein. The various features and elements of the technology described herein may be combined in a manner different than the specific examples described or claimed herein without departing from the scope of the technology. In other words, any element or feature may be combined with any other element or feature in different embodiments, unless there is an obvious or inherent incompatibility between the two, or it is specifically excluded.

References in the specification to "one embodiment," "an embodiment," etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described.

The singular forms "a," "an," and "the" include plural reference unless the context clearly dictates otherwise. Thus, for example, a reference to "a plant" includes a plurality of such plants. It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition, or step being referred to is an optional (not required) feature of the technology. The term "and/or" means any one of the items, any combination of the items, or all of the items with which this term is associated.

Each numerical or measured value in this specification is modified by the term "about." The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range (e.g., weight percents of carbon groups) includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third, and upper third, etc.

As will also be understood by one skilled in the art, all language such as "up to," "at least," "greater than," "less than," "more than," "or more," and the like, include the number recited and such terms refer to ranges that can be subsequently broken down into sub-ranges as discussed above. In the same manner, all ratios recited herein also include all sub-ratios falling within the broader ratio. Accordingly, specific values recited for radicals, substituents, and ranges, are for illustration only; they do not exclude other defined values or other values within defined ranges for radicals and substituents.

What is claimed is:

1. An adjustable heel comprising:

a top section configured to couple to a sole portion of an article of footwear at a top surface of the top section, the top section defining a top section vertical cavity, a top section upper horizontal cavity, and a top section lower horizontal cavity, the top section vertical cavity having an opening in a bottom surface of the top section and the top section horizontal cavity extending between the top section vertical cavity and an external surface of the top section;

a movable top locking pin positioned at least partially within the top section upper horizontal cavity;

a bottom section coupled to the top section and configured to contact a walking surface at a bottom surface of the bottom section, the bottom section configured to extend beyond the bottom surface of the top section when extended and to be contained at least partially within the top section vertical cavity when retracted, the bottom section defining a bottom section upper horizontal cavity having an opening in an external surface of the bottom section; and a movable spring-loaded locking pin positioned at least partially within the bottom section upper horizontal cavity, the spring-loaded locking pin configured to hold the bottom section in an extended or retracted position when the spring-loaded locking pin is positioned partially within the bottom section upper horizontal cavity and the spring is at most partially compressed and to allow the bottom section to move when the spring-loaded locking pin is positioned completely within the bottom section upper horizontal cavity; and at least one intermediate section positioned between the top section and the bottom section, each intermediate section defining a respective intermediate section vertical cavity, a respective intermediate section upper horizontal cavity, and a respective intermediate section lower horizontal cavity, each intermediate section upper and lower horizontal cavities extending between the respective intermediate section vertical cavity and an external surface of the respective intermediate section;

each intermediate section configured to be contained in a next higher section vertical cavity with the respective intermediate section upper horizontal cavity aligned with a next higher section upper horizontal cavity when the intermediate section is in a retracted position and with the respective intermediate section upper horizontal cavity aligned with a next higher section lower horizontal cavity when the intermediate section is in an extended position;

each intermediate section vertical cavity configured to contain a next lower section with a next lower section upper horizontal cavity aligned with the respective intermediate section upper horizontal cavity when the next lower section is in a retracted position and with a next lower section upper horizontal cavity aligned with the respective intermediate section lower horizontal cavity when the next lower section is in an extended position;

each intermediate section upper horizontal cavity configured to contain at least partially a respective movable intermediate locking pin, each intermediate locking pin configured to hold the respective intermediate section in the extended or retracted position; and each intermediate locking pin configured to move to a locked position in response to a spring force of the spring-loaded locking pin or move to an unlocked position in response to an externally applied force.

2. The adjustable heel of claim 1, further comprising a vertical spring configured to assist extending the bottom section, the vertical spring positioned within each vertical cavity.

3. The adjustable heel of claim 2, wherein each locking pin is configured to extend external to the external surface of its respective section when aligned with the spring-loaded locking pin.

4. The adjustable heel of claim 1, wherein each locking pin is configured to extend external to the external surface of its respective section when aligned with the spring-loaded locking pin.

5. A footwear system comprising:

an upper portion;

a sole portion; and an adjustable heel, the adjustable heel comprising:

a top section configured to couple to the sole portion at a top surface of the top section, the top section defining a top section vertical cavity, a top section upper horizontal cavity and a top section lower horizontal cavity, the top section vertical cavity having an opening in a bottom surface of the top section and each top section horizontal cavity extending between the top section vertical cavity and an external surface of the top section;

a movable top locking pin positioned at least partially within the top section upper horizontal cavity;

a bottom section coupled to the top section and configured to contact a walking surface at a bottom surface of the bottom section, the bottom section configured to extend beyond the bottom surface of the top section when extended and to be contained at least partially within the top section vertical cavity when retracted, the bottom section defining a bottom section upper horizontal cavity having an opening in an external surface of the bottom section; and a movable spring-loaded locking pin positioned at least partially within the bottom section upper horizontal cavity;

the spring-loaded locking pin configured to hold the bottom section in an extended or retracted position when the spring-loaded locking pin is positioned partially within the bottom section upper horizontal cavity and the spring is at most partially compressed and to allow the bottom section to move when the spring-loaded locking pin is positioned completely within the bottom section upper horizontal cavity; and wherein the adjustable heel further comprises at least one intermediate section positioned between the top section and the bottom section, each intermediate section defining a respective intermediate section vertical cavity, a respective intermediate section upper horizontal cavity, and a respective intermediate section lower horizontal cavity, each intermediate section upper and lower horizontal cavities extending between the respective intermediate section vertical cavity and an external surface of the respective intermediate section;

each intermediate section configured to be contained in a next higher section vertical cavity with the respective intermediate section upper horizontal cavity aligned with a next higher section upper horizontal cavity when the intermediate section is in a retracted position and with the respective intermediate section upper horizontal cavity aligned with a next higher section lower horizontal cavity when the intermediate section is in an extended position;

each intermediate section vertical cavity configured to contain a next lower section with a next lower section upper horizontal cavity aligned with the respective intermediate section upper horizontal cavity when the next lower section is in a retracted position and with a next lower section upper horizontal cavity aligned with the respective intermediate section lower horizontal cavity when the next lower section is in a extended position;

each intermediate section upper horizontal cavity configured to contain at least partially a respective movable intermediate locking pin, each intermediate locking pin configured to hold the respective intermediate section in the extended or retracted position;

and each intermediate locking pin configured to move to a locked position in response to a spring force of the spring-loaded locking pin or move to an unlocked position in response to an externally applied force.

6. The footwear system of claim 5, wherein the adjustable heel comprises a vertical spring configured to assist extending the bottom section, the vertical spring positioned within each vertical cavity.

7. The footwear system of claim 6, wherein each locking pin is configured to extend external to the external surface of its respective section when aligned with the spring-loaded locking pin.

8. The footwear system of claim 5, wherein each locking pin is configured to extend external to the external surface of its respective section when aligned with the spring-loaded locking pin.

9. The footwear system of claim 5, further comprising a heating element positioned adjacent a toe section of the sole portion.

10. The footwear system of claim 5, wherein the sole portion comprises at least one flexible section configured to accommodate varying heights of the adjustable heel.

11. The footwear system of claim 10, wherein the sole portion comprises a first flexible section positioned adjacent a toe section and a second flexible section adjacent an arch section.

12. A footwear system comprising:

an upper portion;

a sole portion; and an adjustable heel, the adjustable heel comprising:

a top section configured to couple to the sole portion at a top surface of the top section, the top section defining a top section vertical cavity, a top section upper horizontal cavity and a top section lower horizontal cavity, the top section vertical cavity having an opening in a bottom surface of the top section and each top section horizontal cavity extending between the top section vertical cavity and an external surface of the top section;

a movable top locking pin positioned at least partially within the top section upper horizontal cavity;

a bottom section coupled to the top section and configured to contact a walking surface at a bottom surface of the bottom section, the bottom section configured to extend beyond the bottom surface of the top section when extended and to be contained at least partially within the top section vertical cavity when retracted, the bottom section defining a bottom section upper horizontal cavity having an opening in an external surface of the bottom section;

a movable spring-loaded locking pin positioned at least partially within the bottom section upper horizontal cavity;

the spring-loaded locking pin configured to hold the bottom section in an extended or retracted position when the spring-loaded locking pin is positioned partially within the bottom section upper horizontal cavity and the spring is at most partially compressed and to allow the bottom section to move when the spring-loaded locking pin is positioned completely within the bottom section upper horizontal cavity;

at least one intermediate section positioned between the top section and the bottom section, each intermediate section defining a respective intermediate section vertical cavity, a respective intermediate section upper horizontal cavity, and a respective intermediate section lower horizontal cavity, each intermediate section upper and lower horizontal cavities extending between the respective intermediate section vertical cavity and an external surface of the respective intermediate section;

each intermediate section configured to be contained in a next higher section vertical cavity with the respective intermediate section upper horizontal cavity aligned with a next higher section upper horizontal cavity when the intermediate section is in a retracted position and with the respective intermediate section upper horizontal cavity aligned with a next higher section lower horizontal cavity when the intermediate section is in an extended position;

each intermediate section vertical cavity configured to contain a next lower section with a next lower section upper horizontal cavity aligned with the respective intermediate section upper horizontal cavity when the next lower section is in a retracted position and with a next lower section upper horizontal cavity aligned with the respective intermediate section lower horizontal cavity when the next lower section is in a extended position;

each intermediate section upper horizontal cavity configured to contain at least partially a respective movable intermediate locking pin, each intermediate locking pin configured to hold the respective intermediate section in the extended or retracted position;

each intermediate locking pin configured to move to a locked position in response to a spring force of the spring-loaded locking pin or move to an unlocked position in response to an externally applied force;

a vertical spring configured to assist extending the bottom section, the vertical spring positioned within each vertical cavity and having a first end connected to a bottom surface of the sole portion and a second end connected to a top surface of the bottom section; and each locking pin is configured to extend external to the external surface of its respective section when aligned with the spring-loaded locking pin.

13. The footwear system of claim 12, further comprising a heating element positioned adjacent a toe section of the sole portion.

14. The footwear system of claim 12, wherein the sole portion comprises a plurality of flexible sections configured to accommodate varying heights of the adjustable heel.

* * * * *